United States Patent [19]

Shuku et al.

[11] Patent Number: 4,954,477

[45] Date of Patent: Sep. 4, 1990

[54] HEAT-SENSITIVE RECORDING MATERIALS

[75] Inventors: Shigekazu Shuku, Nara; Shunichiro Mukoyoshi, Hyogo; Eiji Yuasa, Hyogo; Tsunefumi Yamori, Hyogo, all of Japan

[73] Assignee: Kanzaki Paper Mfg. Co., Ltd., Tokyo, Japan

[21] Appl. No.: 342,049

[22] Filed: Apr. 24, 1989

[30] Foreign Application Priority Data

Apr. 28, 1988 [JP] Japan ..... 63-106912

[51] Int. Cl.[5] ..... B41M 5/18

[52] U.S. Cl. ..... 503/226; 427/152; 428/447; 428/913; 503/200

[58] Field of Search ..... 503/200, 226; 428/913, 428/914, 447; 427/152; 525/100

[56] References Cited

U.S. PATENT DOCUMENTS 4,812,438 3/1989 Yamori et al. ..... 503/200

4,833,116 5/1989 Yamori et al. ..... 503/200

FOREIGN PATENT DOCUMENTS 57-105392 6/1982 Japan ..... 503/226

*Primary Examiner*—Pamela R. Schwartz

*Attorney, Agent, or Firm*—Finnegan, Henderson, Farabow, Garrett and Dunner

[57] ABSTRACT

A heat-sensitive recording material comprising a support, a heat-sensitive recording layer containing a color former and a color developer forming color by the contact with the color former formed on the support, an interlayer containing a water-soluble resin or a water-dispersible resin as the main component formed on the heat-sensitive recording layer, and an overcoat layer formed by forming a layer containing (1) a macromonomer having a polymerizable functional group at one terminal of the molecular chain, the main component of the segment being organopolysiloxane and (2) a resin capable of being cured by electron beams on the interlayer and curing the layer by the irradiation of electron beams.

7 Claims, No Drawings

HEAT-SENSITIVE RECORDING MATERIALS

FIELD OF THE INVENTION

This invention relates to a heat-sensitive recording material, and more particularly to a heat-sensitive recording material excellent in a paper feed (sticking) property even under a high humidity environment.

BACKGROUND OF THE INVENTION

Hitherto, a heat-sensitive recording material of obtaining colored images by contacting a color former and a color developer by the action of heat by utilizing the reaction of both components. Since such a heat-sensitive recording material is relatively inexpensive and also the recording device is compact and requires faily easy maintenance, the recording material is used not only as recording media for facsimile and various kinds of computers but also for other wide field of arts such as heat-sensitive labels, etc.

However, a heat-sensitive recording material has weak points in fingerprint resistance and solvent resistance. For example, when the recording layer thereof is brought into contact with a sebum of finger or a solvent, the recording density is reduced or an unnecessary color called as background fog forms.

For solving such a problem, there are proposed a method of coating an aqueous emulsion of a resin having a film-forming faculty and a chemical resistance on the heat-sensitive recording layer as disclosed in JP-A-54-128347 (the term "JP-A" as used herein means an "unexamined published Japanese patent application"), a method of coating a solution of a water-soluble polymer such as polyvinyl alcohol, etc., on the heat-sensitive recording layer as disclosed in JP-A-U-56-125354 (the term "JP-A-U" as used herein means an "unexamined published Japanese utility model application"), etc. However, the improvement by these methods is accompanied by new disadvantages and satisfactory results are not always obtained at present.

For example, when a coating of the aqueous resin is applied on the heat-sensitive recording layer, it is required to restrict the drying temperature for preventing coloring of the recording layer with a high temperature drying, whereby curing of the resin layer is, as a matter of course, insufficient to cause a phenomenon of sticking the resin layer to a recording head druing the recording.

Accordingly, it has been proposed to coat a resin component capable of being cured by electron beams on the heat-sensitive recording layer and cure the resin component by electron beams. However, such a method is yet insufficient in the preservability of recorded images. In addition, there may also be problems that the electron beam-curable resin layer causes coloration of the heat-sensitive recording layer just after it has been coated or causes fading of recorded images.

As the result of various investigations for solving these problems, the inventors previously discovered that by forming an interlayer of an aqueous resin on the heat-sensitive recording layer and thereafter forming thereon an overcoat layer containing a resin that is curable upon exposure to electron beams, a heat-sensitive recording material showing improved preservability of recorded images without being accompanied by the formation of fog on the recording layer, having widely varying surface characteristics, and having excellent recording characteristics was obtained as shown in JP-A-62-279980.

On the other hand, recently, various printers such as video printers, etc., which can provide high quality images comparable to photographs are used and even with regard to a heat-sensitive recording material for print out, more excellent recording density and gradation have been required. For the purpose, the development of heat-sensitive recording materials using a plastic film or a synthetic paper as the support and having excellent gradation of recorded images has been made and for improving the preservability of recorded images on such a heat-sensitive recording material, it has been attempted to form an overcoat layer of an aqueous resin, etc., on the recording layer. However, when the heat-sensitive recording material having the overcoat layer composed of an aqueous resin is used for recording by a video printer under a high humidity condition, it has been found that the overcoat layer tends to stick to a recording head or paper feed guides to cause paper clogging. Also, the record density is still insufficient.

As the result of various investigations on such problems, the inventors further discovered that by forming a heat-sensitive recording layer on a plastic film or a synthetic paper, forming an interlayer of an aqueous resin on the heat-sensitive recording layer, and then forming an overcoat layer containing a resin curable upon exposure to electron beams followed by curing by electron beams, a heat-sensitive recording material giving high recording density, having excellent gradation and preservability of recorded images, and causing no sticking onto a recording head even under a high humidity condition was obtained and previously filed as European Patent No. 264,827A.

However, it has been clarified that when even the recording material having excellent characteristics as described above is used for recording by a video printer of printing at a particularly high speed, a sticking phenomenon to a recording head still occurs even by using the electron beam-curable resin as the resin for forming the overcoat layer to cause a problem in the paper feed property or sticking (a heat-sensitive recording material sticks to a thermal head and is not fed smoothly). Such a problem can be improved to some extent by the addition of a pigment to the overcoat layer but the aforesaid improvement is still insufficient in paper feed property in a particularly highhumidity condition or a condition of attaching moisture or a sebum of human skin onto the surface of the recording material.

SUMMARY OF THE INVENTION

The object of this invention is, therefore, to solve the aforesaid problem and to provide a heat-sensitive recording material excellent in paper feed property.

That is, according to this invention, there is provided a heat-sensitive recording material comprising a support, a heat-sensitive recording layer containing a color former and a color developer forming color by the contact with the color former formed on the support, an interlayer composed of a water-soluble resin or a water-dispersible resin as the main component formed on the heat-sensitive recording layer, and a layer containing (1) a macromonomer having a polymerizable functional group at one terminal of the molecular chain, the main component of the segment being organopolysiloxane, and (2) a resin curable upon exposure to electron beams formed on the interlayer, said layer being cured by the irradiation of electron beams to form an overcoat layer.

DETAILED DESCRIPTION OF THE INVENTION

There is not particular restriction on the combination of a color former and a color developer existing in the heat-sensitive recording layer in this invention and any combinations thereof capable of causing coloring reaction by the contact of both components by the action of heat can be used in this invention. For example, there are a combination of a colorless or pale colored basic dye and an inorganic or organic acidic material and a combination of a higher fatty acid metal salt such as ferric stearate and a phenol such as gallic acid.

However, the combination of a basic dye and an acidic material gives very excellent recording characteristics and hence is particularly preferred in this invention.

There are various kinds of colorless or pale colored basic dyes and specific examples thereof are triarylmethane series dyes such as 3,3-bis(p-dimethyl-aminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.; diphenylmethane series dyes such as 4,4'-bis-dimethylaminobenzhydrylbenzyl ether, N-halophenylleucoauramines, N-2,4,5-trichlorophenylleucoauramine, etc.; thiazine series dyes such as benzoyl leucomethylene blue, p-nitrobenzoyl leucomethylene blue, etc.; spiro series dyes such as 3-methyl-spiro-dinaphthopyran, 3-ethyl-spiro-dinaphthopyran, 3-phenylspiro-dinaphthopyran, 3-benzyl-spiro-dinaphthopyran, 3-methyl-naphtho(6'-methoxybenzo)spiropyran, 3-propylspiro-dibenzopyran, etc.; lactam series dyes such as rhodamine-B-anilinolactam, rhodamine(p-nitroanilino)-lactam, rhodamine(o-chloroanilino)lactam, etc.; and fluoran series dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, etc.

Also, as the inorganic or organic acidic materials capable of causing coloring reaction by the contact with the colorless or pale colored basic dye, there are various materials. For example, there are inorganic acidic materials such as activated clay, acid clay, attapulgite, bentonite, colloidal silica, aluminum silicate, etc., and organic acidic materials such as phenolic compounds [e.g., 4-tert-butylphenol, 4-hydroxydiphenoxide, α-naphthol, β-naphthol, 4-hydroxyacetophenol, 4-tert-octylcatechol, 2,2'-dihydroxydiphenol, 2,2'-methylenebis(4-methyl-6-tert-isobutylphenol), 4,4'-isopropylidenebis(2-tert-butylphenol), 4,4'-sec-butylidenediphenol), 4-phenylphenol, 4,4'-isopropylidenediphenol (bisphenol A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, novolak type phenol resins, and phenol polymers], aromatic carboxylic acids [e.g., benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)-salicylic acid, and 3,5 di-α-methylbenzylsalicylic acid], and also the salts of the aforesaid phenolic compounds or aromatic carboxylic acids with polyvalent metals such as zinc, magnesium, aluminum, calcium, titanium, manganese, tin, nickel, etc.

In the heat-sensitive recording material of this invention, the ratio of the color former and the color developer in the heat-sensitive recording layer is properly selected according to the kinds of them and hence there is no particular restriction on the ratio. However, in the case of using a colorless or pale colored basic dye and an acidic material, the acidic material is used in an amount of generally from about 1 to 50 parts by weight, and preferably from 1 to 10 parts by weight per part by weight of the colorless or pale colored basic dye.

The coating composition containing these materials is generally prepared by dispersing the color former and the color developer separately or simultaneously in water as the dispersion medium by a stirring or grinding means such as a ball mill, an attritor, or a sand mill, etc.

To the coating composition is added an adhesive such as starches, hydroxyethyl cellulose, methyl cellulose, carboxymethyl cellulose, gelatin, casein, gum arabic, polyvinyl alcohol, diisobutylene.maleic anhydride copolymer salts, styrene.maleic anhydride copolymer salts, ethylene.acrylic acid copolymer salts, styrene.acrylic acid copolymer salts, styrene.butadiene copolymer emulsions, etc., in an amount of from about 10 to 40% by weight, and preferably from 15 to 30% by weight of the whole solid components.

Furthermore, the coating composition can contain various kinds of auxiliary agents such as dispersants (e.g., sodium dioctylsulfosuccinate, sodium dodecylbenzenesulfonate, sodium salts of lauryl alcohol sulfuric acid ester, alginic acid salts, fatty acid metal salts, etc.), ultraviolet absorbents (e.g., benzophenone series absorbents and triazole series absorbents), defoaming agents, fluorescent dyes, colored dyes, etc.

Other additives that may be incorporated in the coating composition include: a lubricant such as zinc stearate, calcium stearate, polyethylene wax, carnauba wax, paraffin wax, ester wax, etc., an inorganic pigment such as kaolin, clay, talc, calcium carbonate, calcined clay, titanium oxide, diatomaceous earth, fine granular anhydrous silica, etc., and a sensitizer such as stearic acid amide, stearic acid methylenebisamide, oleic acid amide, palmitic acid amide, sperm oleic acid amide, coconut fatty acid amide, etc.

In the heat-sensitive recording material for video printer, a gradation (the reproducibility of an intermediate tone) is important and for this purpose, a heat-sensitive material having a highly smooth surface is preferred. Accordingly, in the case of using the heat-sensitive recording material for this purpose, a plastic film or a synthetic paper is preferably used as the support for the recording paper but a coated paper or a wood free paper having adhered thereonto a plastic film or a synthetic paper using an adhesive and a paper laminated with plastic may be used.

As the plastic film, there are, for example, films of polyethylene, polyester, polyvinyl chloride, polystyrene, nylon, etc. Synthetic papers which can be used may be divided into two groups manufactured by a film process and a fiber process. The film process includes an internal paper-making process wherein a synthetic resin is melt kneaded together with fillers and additives and then extruded to form a film; a surface coating process wherein a pigment coating layer is provided; and a surface treating process. Further, synthetic papers made by the fiber process include synthetic pulp paper, spun bond paper, etc. Among these supports, plastic films and synthetic papers by the film process are preferable because they can provide particularly excellent recording characteristics.

Also, by forming an antistatic layer on the back surface of the support, sticking of dust on the support by static electricity can be prevented, and excellent recorded images are obtained.

There is no particular restriction on the coating method of the recording layer and the recording layer can be formed according to conventional coating techniques. For example, the recording layer is formed by coating the coating composition by bar coating, air knife coating, rod blade coating, pure blade coating, Short Dwell coating, etc., and drying.

In addition, in the case of using a plastic film as the support, the coating efficiency can be increased by applying corona discharging, electron beam irradiation, etc., to the surface of the film.

Also, there is no particular restriction on the coating amount of the coating composition and the coating amount is in the range of from about 2 to 12 g/m$^2$, and preferably from 3 to 10 g/m$^2$ on a dry weight basis.

In the heat-sensitive recording material of this invention, an interlayer is formed on the heat-sensitive recording layer thus formed and as the water-soluble or water-dispersible resin for the interlayer, the following resins can be used.

That is, as the aforesaid resins, there are, for example, completely or partially saponified polyvinyl alcohols; acetoaceylated polyvinyl alcohols in which an acetoacetyl group has been introduced by reaction between polyvinyl alcohol and diketene, etc.; reaction products of polyvinyl alcohol and polycarboxylic acids such as fumaric acid, phthalic anhydride, trimellitic anhydride, and itaconic anhydride, or esterified products of these reaction products; carboxy-modified polyvinyl alcohols obtained as saponification products of copolymers of vinyl acetate and ethylenically unsaturated carboxylic acids such as maleic acid, fumaric acid, itaconic acid, crotonic acid, acrylic acid, and methacrylic acid; sulfonic acid-modified polyvinyl alcohols obtained as saponification products of copolymers of vinyl acetate and olefinic sulfonic acids such as ethylenesulfonic acid and allylsulfonic acid or salts thereof; olefin-modified polyvinyl alcohols obtained by saponifying copolymers of vinyl acetate and olefins such as ethylene, propylene, isobutylene, α-octene, α-dodecene, and α-octadodecene; nitrile-modified polyvinyl alcohols obtained as saponification products of copolymers of vinyl acetate and nitriles such as acrylonitrile and methacrylonitrile; amide-modified polyvinyl alcohols obtained by saponifying copolymers of vinyl acetate and amides such as acrylamide and methacrylamide; pyrrolidone-modified polyvinyl alcohols obtained by saponifying copolymers of vinyl acetate and N-vinylpyrrolidone; cellulose derivatives such as methyl cellulose, ethyl cellulose, hydroxyethyl cellulose, and carboxymethyl cellulose, etc.; casein; gum arabic; starches such as oxidized starch, etherified starch, dialdehyde starch, and esterified starch, etc.; a styrene/butadiene copolymer emulsion; a vinyl acetate/vinyl chloride/ethylene copolymer emulsion; and a methacrylate/butadiene copolymer emulsion, etc.

In these water-soluble resins or water-dispersible resins, various modified polyvinyl alcohols, cellulose derivatives, and casein are preferred, and, in particular, acetoacetylated polyvinyl alcohol and carboxyl-modified polyvinyl alcohol are preferred.

The interlayer can further contain pigment(s) for increasing the smoothness. Specific examples of the pigment for use in this invention are inorganic pigments such as calcium carbonate, zinc oxide, aluminum oxide, titanium dioxide, silicon dioxide, aluminum hydroxide, barium sulfate, zinc sulfate, talc, kaolin, clay, calcined clay, colloidal silica, etc.; and organic pigments such as polystyrene microball, nylon powder, polyethylene powder, urea-formalin resin filler, raw starch particle, etc. The addition amount of the pigment in the interlayer is from about 5 to 500 parts by weight, and preferably from 80 to 350 parts by weight per 100 parts by weight of the resin component.

Furthermore, the coating composition for forming the interlayer may further contain, if required, a hardening agent such as glyoxal, methylolmelamine, potassium persulfate, ammonium persulfate, sodium persulfate, ferric chloride, magnesium chloride, boric acid, ammonium chloride, etc. The coating composition may further contain, if required, a variety of auxiliary agents such as a lubricant such as zinc stearate, calcium stearate, stearic acid amide, polyethylene wax, carnauba wax, paraffin wax, ester wax, etc.; a surface active agent such as sodium dioctylsulfosuccinate, sodium dodecylbenzenesulfonate, sodium salts of lauryl alcohol sulfuric acid ester, alginic acid salts, fatty acid metal salts, etc.; an ultraviolet absorbent such as benzophenone series absorbents, triazole series absorbents, etc.; a defoaming agent; a fluorescent dye; a colored dye, etc.

The coating composition for the interlayer is generally prepared as an aqueous coating composition and after, if required, sufficiently mixing and dispersing by a mixer, attritor, ball mill, roll mill, etc., coated on the aforesaid heat-sensitive recording layer by a conventional coating means. After coating, the interlayer is cured by a conventional drying means or by exposure to ultraviolet rays or electron beams.

When a hardening agent is used for the interlayer, the hardening agent can be added to the coating composition for forming the interlayer and/or the hardening agent can be added to other coating composition which is further coated on the interlayer. The latter case of coating a hardening agent on the interlayer has an advantage that a strong hardening agent can be selected without need of considering the reduction of the pot life of the coating composition for the interlayer.

Also, if required, a coated layer similar to the interlayer can be formed at the back surface of the heat-sensitive recording material, whereby the preservability of recorded images can be further improved. Furthermore, various techniques known in the production field of heat-sensitive recording materials, such as the formation of subbing layer under the recording layer, or an adhesive may be applied to the back surface of the recording material so as to make an adhesive label.

There is no particular restriction on the coating amount of the coating composition for forming the interlayer but the coating amount of from about 0.1 to 20 g/m$^2$, and preferably from 0.5 to 10 g/m$^2$ since if the coating amount is less than 0.1 g/m$^2$, the desired effect of this invention cannot be sufficiently obtained and if the coating amount is over 20 g/m$^2$, the recording sensitivity of the heat-sensitive recording material may be reduced.

Also, since by increasing the smoothness of the surface of the interlayer, the heat-sensitive recording material having a high recording density and high gloss is obtained, it is desirable that the surface of the interlayer is smoothened to at least 300 seconds, and preferably at least 3,000 seconds as a Bekk smoothness by treating the surface thereof with a super calender, etc.

In addition, in order to further improve the adhesiveness between the interlayer and the overcoat layer formed on the interlayer, a corona discharge treatment may be employed to the interlayer.

Then, on the interlayer thus formed is formed an overcoat layer containing an electron beam-curable resin and a macromonomer having a polymerizable functional group at one terminal of the molecular chain, the main component of the segment being organopolysiloxane.

As the electron beam-curable resin, for forming the overcoat layer, there are exemplified prepolymers and monomers as illustrated below.

Examples of useful electron beam-curable prepolymers include:

(a) Poly(meth)acrylates of aliphatic, alicyclic, or araliphatic polyhydric (having from 2 to 6 alcoholic hydroxyl groups) alcohols or polyalkylene glycols, such as esterified compounds of polyhydric alcohols (e.g., ethylene glycol and propylene glycol) or polyalkylene glycols (e.g., polyethylene glycol) and (meth)acrylic acid;

(b) Poly(meth)acrylates of polyhydric alcohols resulting from addition of alkylene oxides to aliphatic, alicyclic, or araliphatic polyhydric (having from 2 to 6 alcoholic hydroxyl groups) alcohols, such as esterified compounds of polyhydric alcohols resulting from addition of alkylene oxides (e.g., ethylene oxide) to polyhydric alcohols (e.g., pentaerythritol) and (meth)acrylic acid;

(c) Poly(meth)acryloyloxyalkyl phosphates resulting from reaction of hydroxyl group-containing meth)acrylates and phosphorus pentoxide, e.g., poly(meth)acryloyloxyethyl phosphate;

(d) Polyester poly(meth)acrylates resulting from esterification of (meth)acrylic acid, polyhydric alcohols, and polycarboxylic acids, e.g., di(meth)acrylate of polyester diol between maleic acid and ethylene glycol, di(meth)acrylate of polyester diol between phthalic acid and diethylene glycol, and poly(meth)acrylate of polyester diol between adipic acid and triethylene glycol;

(e) Epoxy poly(meth)acrylates which are a reaction product of (meth)acrylic acid and epoxy resin resulting from reaction of polyhydric phenols and epichlorohydrin, e.g., a reaction product of bisphenol Adiglycidyl ether-based epoxy resin and (meth)acrylic acid;

(f) Polyurethane poly(meth)acrylates such as reaction products of hydroxyl group-containing (meth)-acrylates (e.g., 2-hydroxyethyl (meth)acrylate) and diisocyanate;

(g) Polyamide poly(meth)acrylates such as reaction products of polyamide-based polycarboxylic acids (e.g., that resulting from reaction of ethylenediamine and phthalic acid) and hydroxyl group-containing (meth)-acrylates (e.g., 2-hydroxyethyl (meth)acrylate);

(h) Polysiloxane poly(meth)acrylates such as reaction products of polysiloxane bond unit-containing polyhydric alcohols and (meth)acrylic acid or hydroxyl group-containing (meth)acrylates;

(i) Low molecular weight vinyl or diene polymers containing (meth)acryloyloxy group in the side chain and/or terminal thereof, such as reaction products of copolymers of (meth)acrylic acid and other vinyl monomer and glycidyl (meth)acrylate; and (j) Modified products of the oligoester (meth)-acrylates of (a) to (i) above, such as modified products obtained by modifying a part of the hydroxyl or carboxyl groups remained in the oligoester with an acid chloride, an acid anhydride, or an isocyanate.

Examples of useful electron beam-curable monomers include:

I. Monofunction Unsaturated Monomers (1) Carboxyl group-containing monomers exemplified by ethylenically unsaturated mono- or polycarboxylic acids (e.g., maleic acid, fumaric acid, and itaconic acid), and carboxylic acid salt group-containing monomers such as alkali metal salts, ammonium salts, and amine salts of the foregoing monomers;

(2) Amide group-containing monomers exemplified by ethylenically unsaturated (meth)acrylamides or alkyl substituted (meth)acrylamides (e.g., N,N-dimethyl (meth)acrylamide), and vinyl lactams (e.g., N-vinylpyrrolidone);

(3) Sulfonic acid group-containing monomers exemplified by aliphatic or aromatic vinylsulfonic acids, and sulfonic acid salt group-containing monomers such as the alkali metal, ammonium, and amine salts of the foregoing vinylsulfonic acids, e.g., 2-acrylamido-2-methylpropanesulfonic acid;

(4) Hydroxyl group-containing monomers exemplified by ethylenically unsaturated esters of polyols, such as tripropylene glycol mono(meth)acrylate;

(5) Amino group-containing monomers such as dimethylaminoethyl (meth)acrylate and 2-vinylpyridine;

(6) Quaternary ammonium salt group-containing monomers such as N,N,N-trimethyl-N-(meth)acryloyloxyethylammonium chloride;

(7) Alkyl esters of ethylenically unsaturated carboxylic acids, such as methyl (meth)acrylate and ethyl (meth)acrylate;

(8) Nitrile group-containing monomers such as (meth)acrylonitrile;

(9) Styrene;

(10) Ethylenically unsaturated alcohol esters such as vinyl acetate and (meth)allyl acetate; and

(11) Mono(meth)acrylates of alkylene oxide adducts of compounds containing active hydrogen (e.g., monohydric alcohols, phenols, carboxylic acids, amines, and amides).

II. Difunctional Unsaturated Monomers (1) Ester group-containing difunctional monomers exemplified by diesters of polyols and ethylenically unsaturated carboxylic acids, such as trimethylolpropane di(meth)acrylate, and diesters of polybasic acids and unsaturated alcohols, such as diallyl phthalate;

(2) Difunctional diesters of (meth)acrylic acid and alkylene oxide adducts of compounds containing active hydrogen (e.g., polyhydric alcohols, phenols, carboxylic acids, amines, and amides) such as pentanediol propylene oxide adduct;

(3) Bisacrylamides such as N,N-methylenebisacrylamide; and (4) Difunctional compounds such as divinylbenzene, divinylethylene glycol, divinylsulfone, divinyl ether, and divinyl ketone.

III. Polyfunctional Unsaturated Monomers (1) Ester group-containing polyfunctional monomers exemplified by polyesters of polyols and ethylenically unsaturated carboxylic acids, such as trimethylolpropane (meth)acrylate and dipentaerythritol hexa(meth)acrylate, and polyesters of polycarboxylic acids and unsaturated alcohols, such as triallyl trimellitate;

(2) Polyfunctional monomers exemplified by polyesters of alkylene oxide adducts of compounds containing active hydrogen (e.g., polyhydric alcohols, polyhydric phenols, polycarboxylic acids, polyamines, and polyamides) and (meth)acrylic acid; and (3) Polyfunctional unsaturated monomers such as trivinylbenzene.

In addition, an electron beam-curable resin having a glass transition point (Tg) after curing of at least 150° C. is particularly preferred owing to the excellent effect of preventing sticking to a recording head at high speed recording and examples of such a resin are polyfunctional monomers [e.g., pentaerythritol triacrylate, pentaerythritol tetraacrylate, pentaerythritol monoacetyltriacrylate, trimethylolpropane triacrylate, dipentaerythritol hexaacrylate, and tris(acryloxyethyl) isocyanurate], polysiloxane polyacrylate, and tetrafunctional or higher oligoester acrylates.

It is a feature of this invention that in the heat-sensitive recording material of this invention, the overcoat layer is formed by applying the coated layer containing the aforesaid electron beam-curable resin and a macromonomer having a polymerizable functional group at one terminal of the molecular chain, the main component of the segment being organopolysiloxane, and curing by electron beams.

The macromonomer is not particularly restricted in terms of molecular weight but usually has a molecular weight of from about 150 to 50,000 and the main component constituting the organopolysiloxane thereof is illustrated by the following formula

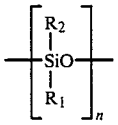

wherein $R_1$ and $R_2$, which may be the same or different, each represents an alkyl group such as methyl, ethyl, propyl, etc., an aryl group such as phenyl, etc., an aralkyl group such as benzyl, etc., or a substituted aryl group such as xylyl, etc., and n is an integer and is not particularly restricted but usually represents an integer of from about 2 to 700. $R_1$ and $R_2$ each is preferably a monovalent hydrocarbon group having from 1 to 19 carbon atoms and having no unsaturated bond. The aforesaid component is most preferably dimethylsiloxane.

The macromonomer has a polymerizable functional group at one terminal of the molecular chain and examples of the functional group are a (meth)acryloyl group, an allyl group, a dicarboxyl group, and a dihydroxyl group. In these groups, a (meth)acryloyl group having a high reactivity by electron beams is particularly preferred. Of course, two or more macromonomers can be used in combination with each other.

The content of the macromonomer in the overcoat layer is in the range of from about 0.01 to 30% by weight, preferably from 0.05 to 15% by weight, and more preferably from 0.1 to 10% by weight based on the whole solid components in the coating composition for the overcoat layer. If the content is less than 0.01% by weight, the sufficient improving effect of the sticking resistance of the recording material under a high humidity environment is not always obtained, while if the content is over 30% by weight, the electron beam curing property of the overcoat layer is likely reduced.

The reason why the heat-sensitive recording material of this invention, having the overcoat layer by curing the coated layer with electron beams, has an excellent paper feed property even under high-humidity conditions or in the state of having sebum or moisture on the surface of the recording material attached by the contact of fingers is considered to be as follows.

That is, it is considered that the macromonomer and the electron beam-curable resin are crosslinked by electron beams to form a graft polymer having organopolysiloxane as the branch component and to form the overcoat layer having the highly crosslinked trunk component owing to the electron beam curing property thereof.

In addition, the coating composition for the overcoat layer may further contain additives such as pigments, electron beam-uncurable resins, defoaming agents, levelling agents, lubricants, surface active agents, plasticizers, ultraviolet absorbents, fluorescent dyes, colored dyes, fluorescent pigments, colored pigments, etc., in addition to the aforesaid electron beam-curable prepolymer or monomer and the aforesaid macromonomer.

It is preferred for obtaining more excellent paper feed property to incorporate an organic or inorganic pigment in the overcoat layer. Examples of these pigments are inorganic pigments such as calcium carbonate, barium carbonate, zinc carbonate, zinc oxide, aluminum oxide, titanium dioxide, silicon dioxide, aluminum hydroxide, barium sulfate, zinc sulfate, talc, kaolin, clay, calcined clay, colloidal silica, pigments obtained by treating the surfaces of the aforesaid inorganic pigments with organic acids, and organic pigments such as polystyrene microball, nylon powder, polyethylene powder, urea-formalin resin powder, cellulose acetate powder, polymethylmethacrylate powder, fluorocarbon resin powder, epoxy resin powder, benzoguanamine resin powder, raw starch particle, etc.

The amount of the pigment added is not particularly restricted but usually ranges from about 1 to 15% by weight based on the whole solid components of the overcoat layer.

The aforesaid coating composition is sufficiently mixed by a proper mixing means such as a mixer, etc., and then coated on the aforesaid interlayer. In this case, if required, the viscosity of the coating composition can be controlled by heating the composition.

There is no particular restriction on the coating amount of the composition but the amount is usually in the range of from about 0.1 to 20 g/m$^2$, and preferably from 0.3 to 10 g/m$^2$ on a dry basis since if the coating amount is less than 0.1 g/m$^2$, the desired effect of this invention is not always obtained, while if the amount is over 20 g/m$^2$, there is a possibility of reducing the recording sensitivity of the heat-sensitive recording material.

The overcoat layer coated on the interlayer is cured by the irradiation of electron beams and the amount of the electron beams applied is in the range of from about 0.1 to 15 Mrads, and preferably from 0.5 to 10 Mrads. If the irradiation amount is less than 0.1 Mrad, the resin composition can hardly be cured and if the amount is over 15 Mrads, there is a possibility of causing undesired color formation or discoloration of the heat-sensitive recording material by the excessive irradiation of electron beams.

As the irradiation system of electron beams, there are a scanning system, a curtain beam system, a broad beam system, etc., and the acceleration voltage at the irradiation of electron beams is properly from about 100 kV to about 300 kV. Also, by subjecting the heat-sensitive recording material having the cured overcoat layer to a smoothening treatment by means of a super calender, etc., the recording density can be further improved and the formation of uneven recorded density can be more reduced.

The following examples serve to illustrate the present invention more practically without limiting, however, the scope thereof. All parts and percents in these examples, unless otherwise indicated, are by weight.

EXAMPLE 1

(1) Preparation of Dispersion A

| (1) Preparation of Dispersion A | |
|---|---|
| 3-(N-Cyclohexyl-N-methylamino)-6-methyl-7-phenylaminofluoran | 10 parts |
| Aqueous solution of 5% methyl cellulose | 5 parts |
| Water | 30 parts |

The aforesaid composition was ground by a sand mill until the mean particle size became 3 μm.

(2) Preparation of Dispersion B

| (2) Preparation of Dispersion B | |
|---|---|
| 4-Hydroxybenzoic acid benzyl | 20 parts |
| Aqueous solution of 5% methyl cellulose | 5 parts |
| Water | 55 parts |

The composition was ground by a sand mill until the mean particle size became 3 μm.

(3) Formation of Recording Layer

A mixture of 45 parts of Dispersion A, 80 parts of Dispersion B, 50 parts of an aqueous solution of 20% oxidized starch, and 10 parts of water was stirred to provide a coating composition. The coating composition thus obtained was coated on a synthetic paper (Yupo ®, a trade name of Oji-Yuka Synthetic Paper Co., Ltd.) of 80 g/m$^2$ at a dry coated amount of 6 g/m$^2$ and dried to provide a heat-sensitive recording material.

(4) Formation of Interlayer

A coating composition having the composition shown below was coated on the recording layer of the heat-sensitive recording material thus obtained at a dry coated amount of 4 g/m$^2$ followed by drying and further subjected to a smoothening treatment by means of a super calender to provide a heat-sensitive recording material having an interlayer of 5,000 seconds in Bekk smoothness.

Composition

| Composition | |
|---|---|
| Aqueous solution of 8% polyvinyl alcohol (PVA-117, a trade name of Kuraray Co., Ltd.) | 1000 parts |
| Calcium Carbonate (Softon ® 1800, a trade name of Bihoku Funka K. K.) | 100 parts |
| Water | 100 parts |

(5) Formation of Overcoat Layer

A coating composition containing 100 parts of a prepolymer mixture of polyester polyacrylate and polyurethane polyacrylate (having Tg after curing of not higher than 100° C., 78E204, a trade name of Mobil Oil Corporation), 2 parts of a macromonomer (AK-5, a trade name of Toagosei Chemical Industry Co., Ltd.), which was a monomer having a methacryloyl group at one terminal of dimethylpolysiloxane, and 5 parts of calcium carbonate having a mean particle size of 0.2 μm (PP-2, a trade name of Komesho Sekkai Kogyo K.K.) was coated on the interlayer at a dry coated amount of 5 g/m$^2$ and then the resin components were cured by treating the layer by an electron curtain-type electron beam irradiator (CB: Type 150, made by ESI Corporation) at an irradiation dosage of 3 Mrads to provide a heat-sensitive recording material having an overcoat layer.

EXAMPLE 2

By following the same procedure as in Example 1 except that the addition amount (2 parts) of the macromonomer (AK-5) for the overcoat layer was changed to 10 parts, a heat-sensitive recording material having an overcoat layer was obtained.

EXAMPLE 3

By following the same procedure as in Example 1 except that 2 parts of a macromonomer (HK-20, a trade name of Toagosei Chemical Industry Co., Ltd.), which was a monomer having a dihydroxyl group at one terminal of dimethylpolysiloxane, was used in place of the macromonomer (AK-5) for the overcoat layer, a heat-sensitive recording material having an overcoat layer was obtained.

EXAMPLE 4

By following the same procedure as in Example 1 except that trimethylolpropane triacrylate (having Tg after curing of 250° C., M-309, a trade name of Toa gosei Chemical Industry Co., Ltd.) was used in place of the prepolymer mixture of polyester polyacrylate and polyurethane polyacrylate as the resin in the coating composition for forming the overcoat layer and that the calcium carbonate was not used for the coating composition, a heat-sensitive recording material having an overcoat layer was obtained.

EXAMPLE 5

By following the same procedure as in Example 4 except that 5 parts of calcium carbonate having a mean particle size of 0.2 μm (PP-2, a trade name of Komesho Sekkai Kogyo K.K.) was added to the coating composition for forming the overcoat layer, a heat-sensitive recording material having an overcoat layer was obtained.

EXAMPLE 6

By following the same procedure as in Example 1 except that the amount (2 parts) of the macromonomer in the coating composition for the overcoat layer was changed to 30 parts, a heat-sensitive recording material having an overcoat layer was obtained.

EXAMPLE 7

By following the same procedure as in Example 1 except that the smoothening treatment of the surface of the interlayer was changed from 5,000 seconds to 250 seconds in Bekk smoothness, a heat-sensitive recording material having an overcoat layer was obtained.

EXAMPLE 8

By following the same procedure as in Example 5 except that the amount (2 parts) of the macromonomer (AK-5) was changed to 0.04 part, a heat-sensitive recording material having an overcoat layer was obtained.

EXAMPLE 9

By following the same procedure as in Example 8 except that the calcium carbonate was not used, a heat-sensitive recording material having an overcoat layer was obtained.

COMPARATIVE EXAMPLE 1

By following the same procedure as in Example 1 except that the macromonomer was not used, a heat-sensitive recording material having an overcoat layer was obtained.

COMPARATIVE EXAMPLE 2

By following the same procedure as in Example 1 except that the overcoat layer was not formed on the interlayer and that the electron irradiation was not applied, a heat-sensitive recording material was obtained.

Using each of the heat-sensitive recording materials thus obtained, image recording was performed by means of a video printer, UP 103 (a trade name of Sony Corporation) and the paper feed property (sticking characteristics) of the recording material and the image quality of the recorded images were evaluated. Furthermore, the color density of the recorded images was measured by a Macbeth densitometer (Type RD-100R, a trade name of Macbeth Corp.). The results obtained are shown in Table 1 below.

Evaluation of Paper Feed Property (Sticking Characteristics)

The evaluation marks shown in Table 1 are as follows.

A: The recording material caused no sticking to a recording head even at high speed recording and travelled very smoothly.

B: The recording material scarcely caused sticking to a recording head even at high speed recording and travelled smoothly.

C: The recording material caused sticking to a recording head at high speed recording to a slight extent that there was no problem for practical use.

D: The recording material sticked to a recording head to cause poor travelling.

Evaluation of Record Image Quality

A: Very excellent with no uneven image.

B: Nearly good almost without uneven image.

C: Uneven image formed to cause problems for practical use.

Furthermore, the surface gloss of each heat-sensitive recording material before recording was measured and the results obtained are also shown in Table 1. The gloss was measured at the incident angle of 60° by a surface photometer. (The numerical value is larger, the luster is higher, such being preferred.)

TABLE 1

| | Density | Paper Feed Property | Gloss | Image Quality |
|---|---|---|---|---|
| Example 1 | 1.85 | B | 95 | A |
| Example 2 | 1.85 | A | 94 | A |
| Example 3 | 1.85 | B | 95 | A |
| Example 4 | 1.86 | A | 95 | A |
| Example 5 | 1.85 | A | 95 | A |
| Example 6 | 1.83 | B | 90 | B |
| Example 7 | 1.80 | B | 88 | B |
| Example 8 | 1.85 | B | 95 | A |
| Example 9 | 1.86 | C | 96 | A |
| Comparative Example 1 | 1.85 | D | 95 | B |
| Comparative Example 2 | 1.30 | B | 8 | A |

As is clear from the results shown in Table 1, it can be seen that the heat-sensitive materials of this invention are excellent in paper feed property under high humidity environment, show high recording density, and are also excellent in gloss and the quality of recorded image.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising:

A. a support,

B. a heat-sensitive recording layer containing a color former and a color developer, color being formed by contact of the color developer with the color former formed on the support, C. an interlayer containing a water-soluble resin or a water-dispersible resin as the main component formed on the heat-sensitive recording layer, and D. an overcoat layer on the interlayer, said overcoat layer being formed by:

(1) forming a layer containing a macromonomer having a polymerizable functional group at one terminal of the molecular chain, the main component of the segment being organopolysiloxane, said polymerizable functional group being at least one member selected from the group consisting of an acryloyl group, a methacryloyl group, an allyl group, a dicarboxyl group, and a dihydroxyl group, and an electron beam-curable resin on the interlayer, and (2) curing the overcoat layer by the irradiation of electron beams.

2. The heat-sensitive recording material as claimed in claim 1, wherein the main component of the segment is an organopolysiloxane represented by the following formula

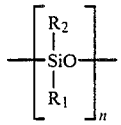

wherein $R_1$ and $R_2$, which may be the same or different, each represents an alkyl group, a substituted or unsubstituted aryl group, or an aralkyl group, and n is an integer.

3. The heat-sensitive recording material as claimed in claim 2, wherein the main component of the segment of the macromonomer is dimethylpolysiloxane.

4. The heat-sensitive recording material as claimed in claim 1, wherein the polymerizable functional group at one terminal of the molecular chain of the macromonomer is an acryloyl group or a methacryloyl group.

5. The heat-sensitive recording material as claimed in claim 1, wherein the support is a plastic film, a synthetic paper, or a sheet formed by laminating a plastic film or a synthetic paper to a coated paper or a wood free paper.

6. The heat-sensitive recording material as claimed in claim 1, wherein the overcoat layer is formed by coating a coating composition for the overcoat layer containing the macromonomer in an amount of from about 0.01 to 30% by weight based upon the total weight of solid components of the composition on the interlayer, followed by curing by irradiation with electron beams.

7. The heat-sensitive recording material as claimed in claim 1, wherein the support is a plastic film, a synthetic paper, or a sheet formed by adhering a plastic film or a synthetic paper to a coated paper or a wood free paper.

* * * * *